United States Patent [19]

Naert

[11] 4,062,257

[45] Dec. 13, 1977

[54] INDEPENDENT, OFF-LINE DEVICE FOR THE CUTTING OF A ROLL OF PAPER INTO SHEETS

[76] Inventor: André Naert, Torhoutsteenweg 112, 8200 Brugge, Belgium

[21] Appl. No.: 658,606

[22] Filed: Feb. 17, 1976

[30] Foreign Application Priority Data

| | | |
|---|---|---|
| Feb. 21, 1975 | Belgium | 284165 |
| Feb. 4, 1976 | Belgium | 254804 |

[51] Int. Cl.[2] ..... B26D 1/56; B26D 7/06

[52] U.S. Cl. ..... 83/110; 83/339; 83/649

[58] Field of Search ..... 83/110, 363, 365, 339, 83/289, 157, 155, 649

[56] References Cited

U.S. PATENT DOCUMENTS

| | | | |
|---|---|---|---|
| 2,538,425 | 1/1951 | Nolan | 83/339 X |
| 3,262,349 | 7/1966 | Hollenton et al. | 83/365 X |
| 3,916,742 | 11/1975 | Biernot | 83/157 |

FOREIGN PATENT DOCUMENTS

| | | | |
|---|---|---|---|
| 18,916 | 6/1970 | Japan | 83/365 |

*Primary Examiner*—Willie G. Abercrombie

[57] ABSTRACT

A device for the cutting of a roll of paper into sheets, comprising the combination of: an independent frame, equipped with a suspension device for a roll of paper; an unrolling mechanism, which leads the paper web from the afore-said roll over a first guide; a cutting device, located between this first guide and a second one; a drive for the aforementioned cutting device; and mechanism to synchronize this drive with the unrolling device, according to the desired cut length of the sheets of paper.

3 Claims, 2 Drawing Figures

INDEPENDENT, OFF-LINE DEVICE FOR THE CUTTING OF A ROLL OF PAPER INTO SHEETS

The present invention relates to an offline, independent device for the cutting of paper rolls into sheets.

The device which forms the subject-matter of this invention consists mainly of the combination of an independent frame, equipped with a suspension device for a roll of paper; an unrolling means, which leads the paper web from the afore-mentioned roll over a first guide means; a cutting device, located between said first guide means and a second guide means; a drive for the aforementioned cutting device; and means to synchronize said drive with said unrolling means, according to the desired cut length of the sheets of paper.

It is obvious that a device of this kind offers many advantages. Since paper rolls are cheaper than pre-cut sheets, the supply of paper will become much improved, from an economical point of view, for business organizations, offices and the like. The main feature of the device is that it works as an independent unit, which is capable of feeding other paper processing machines at any rate. In this connection, it is to be noted that printing and copying machines which are fed from a roll have been used for a long time. But because these machines are equipped with a built-in feeding system, it is almost impossible to print or copy on both sides of the paper; with the independent machine according to the present invention, printing on both sides becomes possible.

Figure 1:
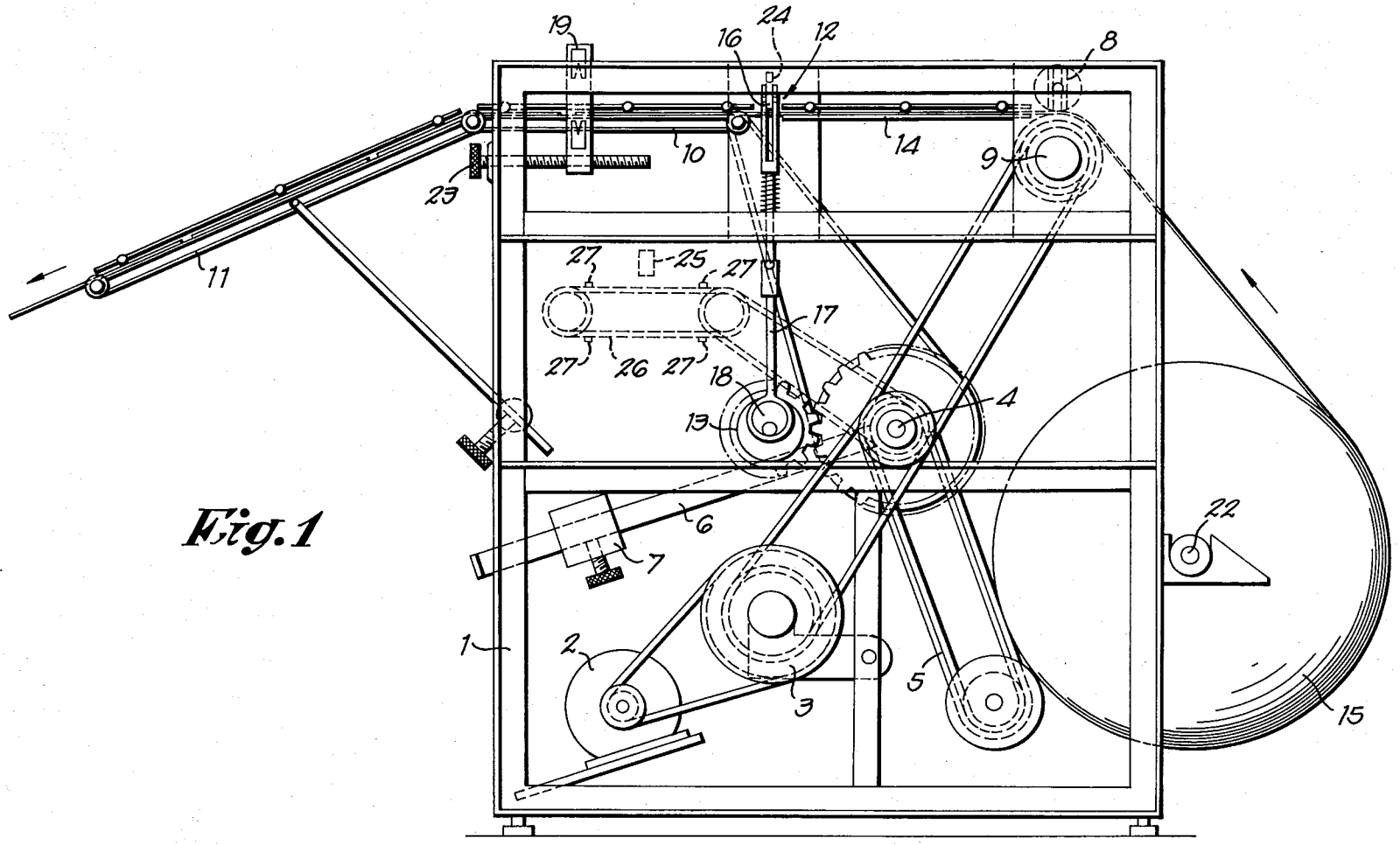
Figure 2:
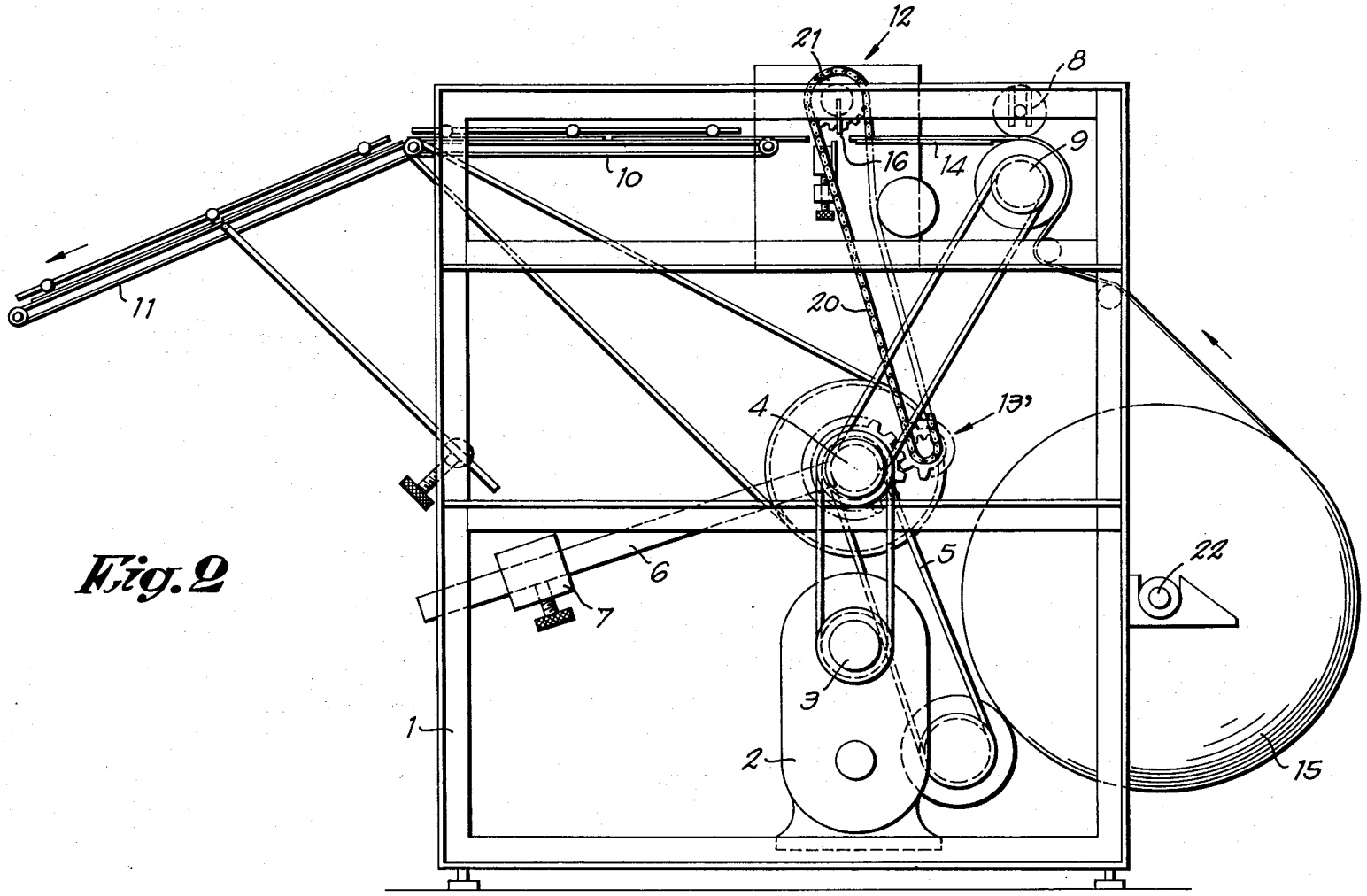

In order to highlight the features of this invention, a detailed description of embodiments is given hereafter, with reference to the attached schematic drawings, in which FIGS. 1 and 2 represent schematic side-views of the aforesaid embodiments.

Identical or similar components have been indicated by the same reference numerals in both FIGS.

As shown on the schematic drawings, the machine comprises a frame 1, and a motor 2 hingedly mounted thereon. This motor 2 drives a main shaft 4 through a rotation speed governor 3. Said main shaft 4 drives several components of the machine, i.e.:

an unrolling device, consisting of an endless band 5 and a lever 6 equipped with an adjustable weight 7, whereby this whole unit 5-7 may swivel around shaft 4;

two feeding rollers 8 and 9 a conveyor belt 10;

an adjustable delivering band 11, and a cutting device 12 actuated through the intermediary of a magnetic clutch 13 (FIG. 1) or of a chain and chain wheel system 13' (FIG. 2).

Between the rollers 8 and 9 and the cutting device 12, a table 14 has been provided on which the paper, delivered from a roll 15 will slide forward.

In the embodiment according of FIG. 1, the cutting device 12 consists of a trimming knife 16, which can be moved up and down through the intervention of a crank 17, controlled by an eccentric shaft 18, which is actuated as soon as the magnetic clutch 13 is switched on.

The switching on and off of this clutch 13 is controlled by a photoelectric cell 19.

In the embodiment according to FIG. 2, the cutting occurs by means of a rotating knife 16, which is driven by a chain 20. Three different toothed wheels — schematically shown at 21-are provided corresponding respectively to three different lengths of paper sheets.

The operation of the device according to the invention is quite simple. A roll of paper 15 is mounted on the machine by means of a freely rotating shaft 22 and the leading edge of the paper web is introduced between the rollers 8 and 9.

The speed governor 3 is adjusted according to the desired output of trimmed sheets.

In the case of FIG. 1, the photoelectric cell 19 is set according to the desired length to which the sheets should be cut; this can be done for instance by means of an adjusting screw 23. In the case of FIG. 2, the chain 20 is placed around the selected toothed wheel 21.

Finally, and if necessary, the angular position of the delivery band 11 is adjusted.

The motor 2 is then started. This causes the roll 15 to unroll so that the paper slides over the table 14 and reaches the conveyor belt 10.

In the embodiment shown in FIG. 1, the magnetic clutch 13 is excited as soon as the paper slides between the elements of the photoelectric cell 19; this will result in the knife 16 cutting the paper band. Since the speed at which the conveyor band 10 is being driven is higher than the driving speed on the rollers 8-9, the sheet of paper that has just been cut is impelled towards the delivering band. The switching off of the magnetic clutch 13, at the moment the knife 16 again reaches its highest position, can for instance occur through a microswitch 24, which, is short circuited as long as the photoelectric cell 19 detects any paper.

In the example according to FIG. 2, the paper is simply cut by the rotating knife 16.

It is evident that the embodiments described above can be extensively modified without departing from the scope of the invention, as defined in the appended claims. Additional cutting devices for instance could be added to the machine allowing cutting of the paper lengthwise.

The photoelectric cell 19 described above could also be substituted by a proximity swtich 25, which is periodically damped to excite the magnetic clutch 13.

This periodical damping can be achieved in different ways. For instance, an endless belt 26 can be driven from the shaft 4, said belt being provided with small metal slabs 27 which each time damp the switch or oscillator 25. The number of these slabs as well as the distance between the individual slabs should preferably be adjustable. Instead of the endless belt 26, the shaft 4 could be provided with a non-conducting disc on which the afore-said slabs would be fitted.

Tests have indicated that such a proximity switch is able to operate with greater accuracy and cheaper than a photoelectric cell.

However, preference could be given to a device according to FIG. 2, since this is of even a simpler construction.

In both cases the frame 1 could be equipped with wheels, so that the cutting device can be moved quite easily.

What I claim is:

1. A device for cutting a roll of paper into sheets, comprising: an independent, self-contained, portable frame, suspension device on said frame for rotatably supporting a roll of paper, a motor mounted on said frame, an output shaft, an adjustable speed governor drivingly coupling said motor and output shaft, an unrolling means pivotably mounted on said frame for engaging the roll of paper and driven from said output shaft for driving the roll in rotation, rotatable feed rollers on said frame driven by said output shaft for feeding the free end of the paper web from the roll, a first guide means on said frame for passage of the web thereon, a second guide means on said frame located downstream of the first guide means, a rotatable knife located between said first and second guide means for cutting said web, a plurality of different diameter sprockets each corresponding to a given length of cut sheets of paper, said sprockets being drivingly coupled to said rotatable knife, each for rotating the knife at at a speed according to the length to which the sheets of paper are to be cut, a chain driven from said output shaft and selectively led over one of said sprockets to drive the knife, and means for synchronizing the drive of the chain with the unrolling means.

2. A device according to claim 1 wherein said second guide means comprises an endless belt driven from said output shaft at a higher velocity than that of the paper web on the first guide means.

3. A device according to claim 1 comprising a delivering band coupled as an extension of said second guide means and having an angle of inclination which is adjustable.

* * * * *